US006471578B1

(12) United States Patent
Yang

(10) Patent No.: US 6,471,578 B1
(45) Date of Patent: Oct. 29, 2002

(54) VENTILATOR BY FORCE OF NATURE WITH PRESSURIZATION CONDUIT HOOD

(76) Inventor: Tai-Her Yang, No. 59, Chung Hsing 8 St., Si-Tu Town, Dzan-Hwa (TW)

( * ) Notice: Subject to any disclaimer, the term of this patent is extended or adjusted under 35 U.S.C. 154(b) by 0 days.

(21) Appl. No.: 09/520,139

(22) Filed: Mar. 7, 2000

(51) Int. Cl.[7] ..... F23L 17/02
(52) U.S. Cl. ..... 454/21; 454/20
(58) Field of Search ..... 454/20, 21, 11, 454/23

(56) References Cited

U.S. PATENT DOCUMENTS 675,952 A * 6/1901 Keller ..... 454/23
1,112,251 A * 9/1914 Bicalky ..... 454/20
1,639,187 A * 8/1927 Kelley ..... 454/23
2,018,020 A * 10/1935 Guenther ..... 454/20
2,785,620 A * 3/1957 Welch ..... 454/20
3,035,506 A * 5/1962 Schrijver ..... 454/23

FOREIGN PATENT DOCUMENTS

GB 20175 * of 1892 ..... 454/23

* cited by examiner

*Primary Examiner*—Harold Joyce
*Assistant Examiner*—Derek S. Boles
(74) *Attorney, Agent, or Firm*—Bacon & Thomas, LLP

(57) ABSTRACT

A wind-powered ventilator includes a pressurization conduit hood mounted on the periphery of an automatic directional type or worm gear type ventilator. The conduit hood is arranged to pressurize atmospheric wind, however feeble and minimal, and conduct the wind to produce a pressurization effect, causing a pressurized wind moment to pass directionally through the ventilator, thereby achieving enhanced drafting efficiency without the intervention of artificial power sources.

8 Claims, 12 Drawing Sheets

VENTILATOR BY FORCE OF NATURE WITH PRESSURIZATION CONDUIT HOOD

BACKGROUND OF THE INVENTION (a) Field of the Invention

Ventilator by Force of Nature with Pressurization Conduit Hood, more specifically, such one, of an Automatic Directional Type or of a Worm Gear Type, externally bound by a Current Conduit Hood, whereby the reducing configuration acting upon incoming, naturally induced wind, will produce a pressurization effect, thereby enhancing the ventilation performance of the ventilator at large.

(b) Description of the Prior Art

By and large, ventilators which operate by force of natural wind seen in the markets come largely either in the type which runs automatically in a direction consistent with prevailing wind direction, or else in the type which works with a Worm Gear; in the former type, a negative pressure zone is produced at the outlet when wind passes by the outlet, that is, the wind will carry away the air at the outlet of the ventilator and that in the meantime have the air in the ventilation pipe sucked out, amounting rightly to a naturally induced drafting effect without necessitating ad hoc artificial power supply, while on the other hand regarding the worm gear type ventilator, executed roughly spheroidal and comprising a number of cambered vane on one side which, when blown by atmospheric wind, will drive the ventilator to operation, while those similarly structured worm gear vanes on the other side serve to exhaust thermal fume indoors at the same time, in this latter instance draft by force of nature is also achieved exempt and free of artificial power source.

While such two types of conventional ventilators as recited above, one of the automatic directional type, the other of the Worm Gear Type, are truly worthy utilities with power exemption, economy advantages, they remain desired of improvement all the same; to put into more precise words, a ventilator is typically meant to draft, exhaust the turbid gases and thermal fumes indoors which are especially intolerable in summertime, and summer happens to be the season with the weakest wind which comes about by nature, particularly at noontime when but very feeble wind by nature is felt, where such is the case, as truly it is a general rule, there is no moment to drive either said Automatic Directional Type or the Worm Gear Type ventilator to operation at all, and that is one point necessitating immediate improvement the sooner the better.

SUMMARY OF THE INVENTION

The primary object of the invention, is to provide design of Ventilator by Force of Nature with Pressurization Conduit Hood which is to be mounted on the periphery of the Ventilator proper, executed to be of either an Automatic Directional Type or else a Worm Gear Type, said Conduit Hood being there to pressurize atmospheric wind, however feeble and minimal, and conduct same to produce pressurized effect rendering a pressurized wind moment to pass directionally through the ventilator, thereby achieving enhanced drafting efficiency without the intervention of artificial power sources.

A further object of the invention is to provide Design of a Ventilator by Force of Nature with Pressurization Conduit Hood Assembly, the Ventilator being of an Automatic Directional Type or else a Worm Gear Type, comprising in addition a series of directional vane which will comply with the prevailing direction in which ambient wind blows thereby realizing pressurizing effect in line with that causal direction.

A further object of the invention is to provide Design of a Ventilator by Force of Nature with Pressurization Conduit Hood Assembly, which incorporates an axial fan on the outlet of the Ventilator, and the series of vane being executed in two stages with that stage, the inner one close to the axis, serving to exhaust off-gas, and that stage, the outer one extending to the outlet of the Conduit Hood, so that such a two-stage chain of vane is driven by the force of wind pressurized accordingly, with the inner stage sucking the air flow resident in the automatic directional ventilator, thereby achieving improved drafting performance.

DETAILED DESCRIPTION OF THE PREFERRED EMBODIMENTS

Figure 1:
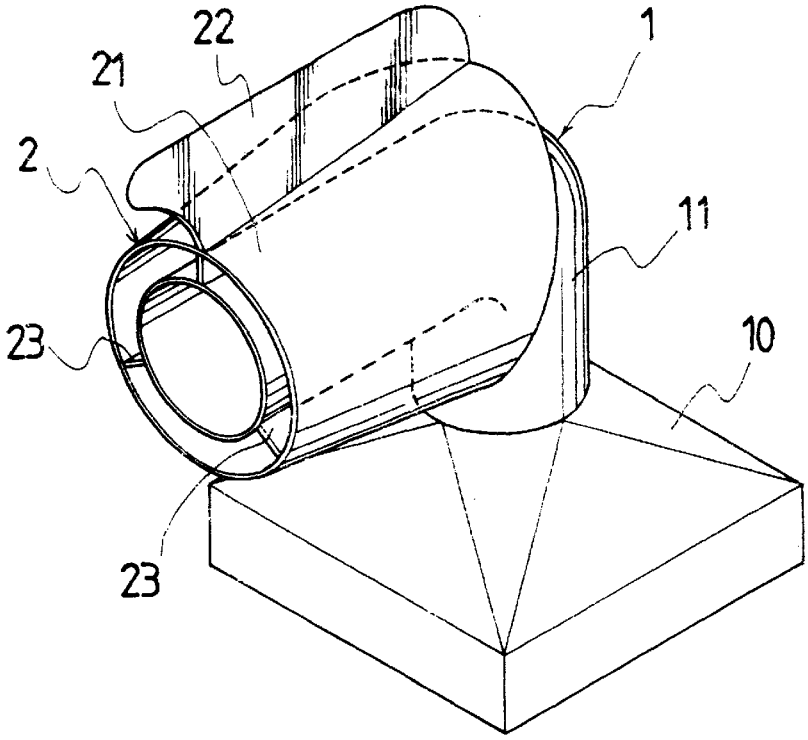
FIG. 1 is a three-dimensional perspective of the invention in the embodiment of an Automatic Directional ventilator.
Figure 2:
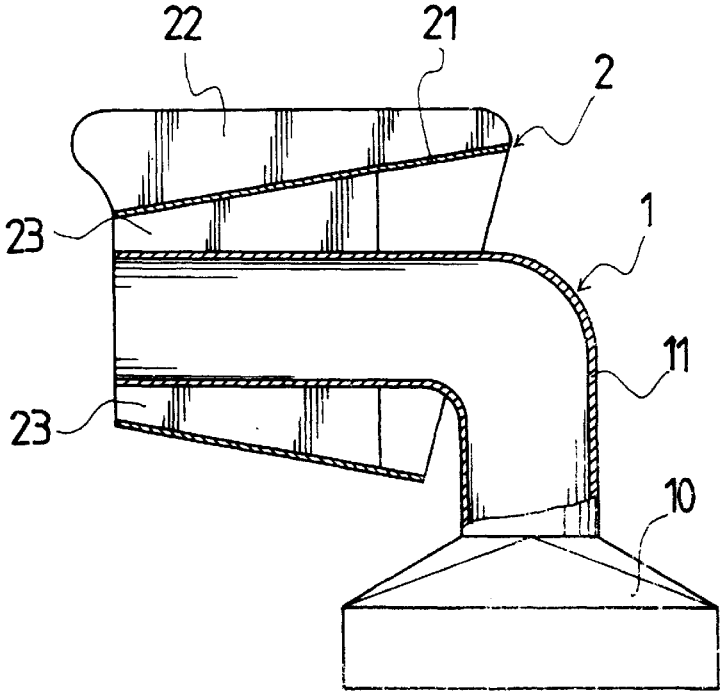
FIG. 2 is a cross-section view of the invention in the embodiment of an Automatic Directional Ventilator.
Figure 2A:
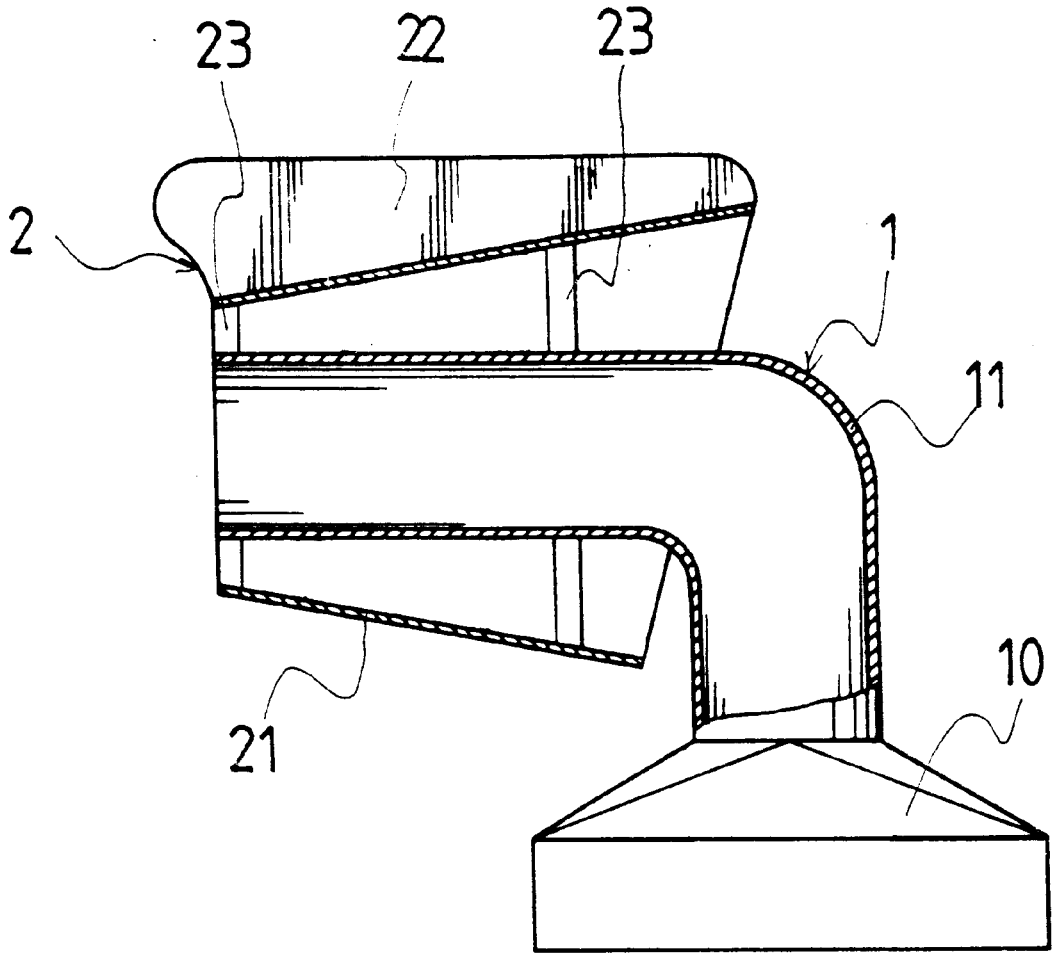
FIG. 2A is an illustration of the internal strutting system of the Current Conduit Hood realized in an embodiment of the invention.

As shown in FIG. 1 through FIG. 8, the invention Ventilator by Force of Nature with Pressurization Conduit Hood comprises essentially an Automatic Directional Draft 1 and a Current Conduit Hood 2, or in an alternative design, a Worm Gear Draft 3 and a Current Conduit Hood 2', engineered such that:

The automatic directional draft 1, such as is shown in FIG. 1, and FIG. 2, consists of an elbow draft pipe 11 with a hollow-set chassis 10, by uniting the vertical port of the elbow 11 with the chassis 10, the elbow 11 is made rotatable upon the chassis 10;

The Current Conduit Hood 2, such as is shown in FIG. 1, FIG. 2, is executed to be hollow-set cylindric 21, with both ends associated with each other, comprising, in addition, an axially extending vane 22 on the outer wall, said vane 22 being in the form of a flat plate, the internal tubular wall of the cylinder 21 integral with one or more ribs 23, or alternatively one or more strutting member 23', such as is shown in FIG. 2A, serving linkage, support and directional follow-through purposes;

By installing the Current Conduit Hood 2 on the perimeter of the traverse section of the draft pipe 11 of the Automatic Directional Ventilator 1 so that the end with the smaller diameter of the cylinder 21 is largely aligned to the outlet of the traverse section of the draft pipe 11, thus fitting the directional vane 22 rightly above the draft pipe 11, the several ribs 23 or strutting rods 23' respectively secured to the wall of the external pipe of the traverse section of the draft pipe 11, there forms by the union of the Current Conduit Hood 2 with the Automatic Directional Draft 1, a Ventilator by Force of Nature with Pressurization Conduit Hood.

Figure 3:
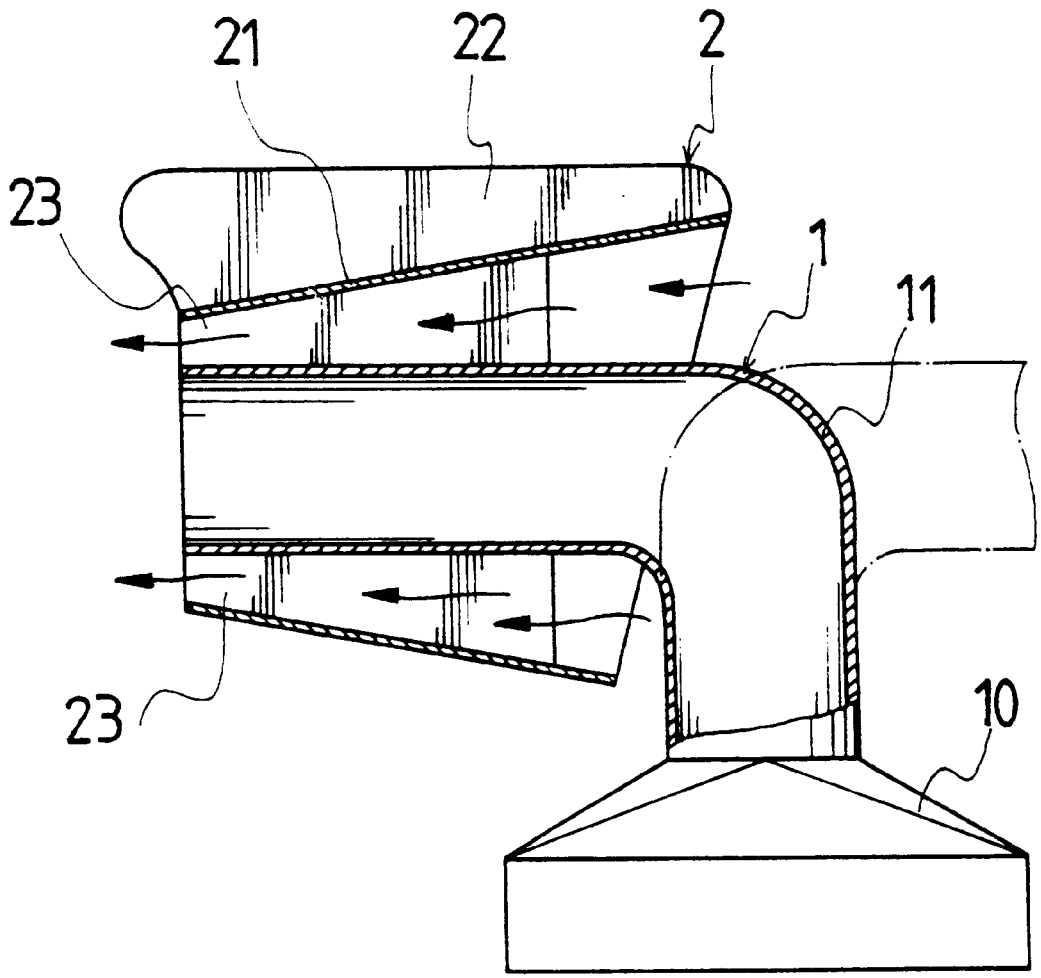
FIG. 3 is an illustration of the invention in the embodiment of an Automatic Directional Ventilator in operation.

The wind-powered ventilator thus assembled may be installed on top of a roof, with the directional vane 22 on top following the direction in which the wind prevails. When natural wind enters the current conduit hood 2, the conically reducing configuration of the hood 2 serves to build up pressure because the exit end of the current conduit hood 2 has a smaller diameter than the entrance, as shown in FIG. 3. As the air passes the exit rim of the elbow draft pipe 11, a zone of negative pressure will be created, and therefore the elbow draft pipe 11 will be able to continuously exhaust hot gas from indoors. The current conduit hood 2 thus increases the force of entering wind so that even with a very weak natural wind, drafting can be maintained by the working of the conduit hood 2, in a manner that is more advantageous than in the case of drafting effects possible with the traditional automatic directional ventilator.

Figure 4:
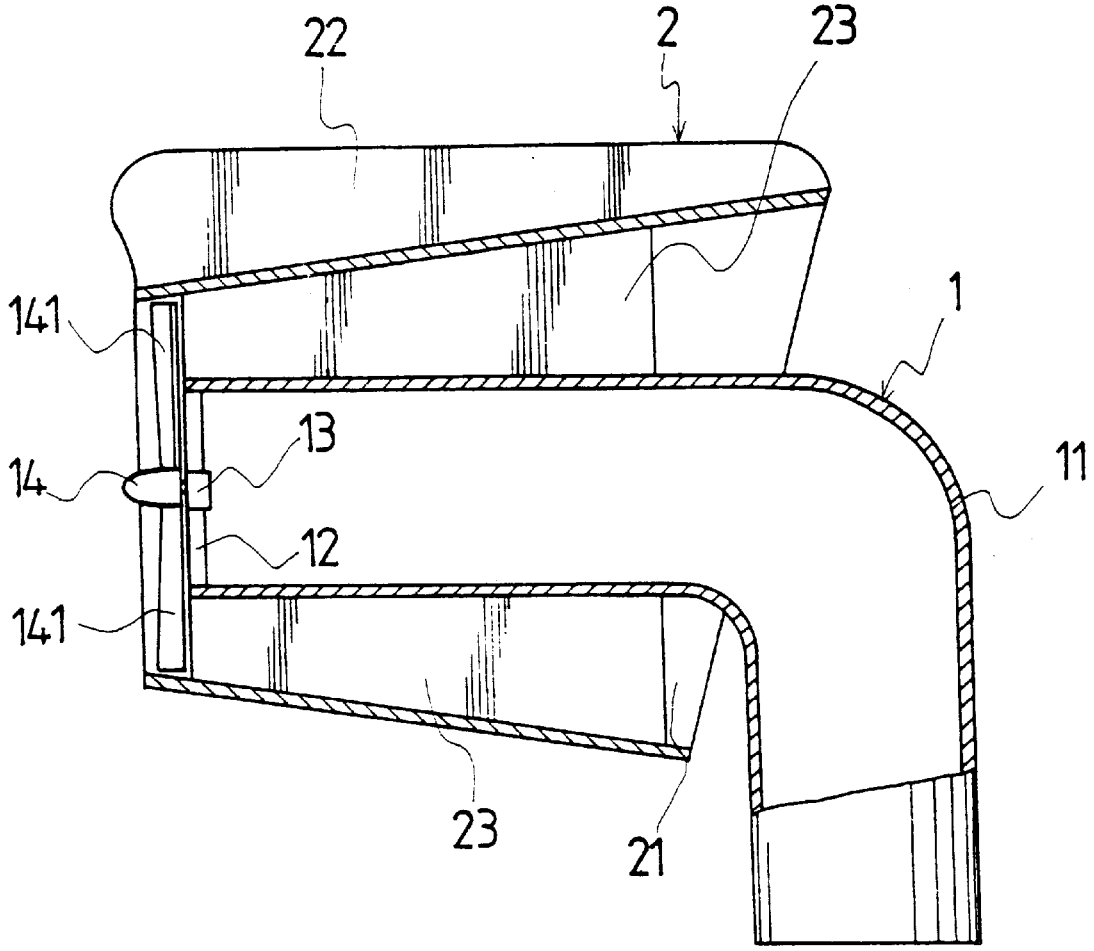
FIG. 4 is a cross-section view of the structural layout of an Automatic Directional Ventilator according to the invention.
Figure 5:
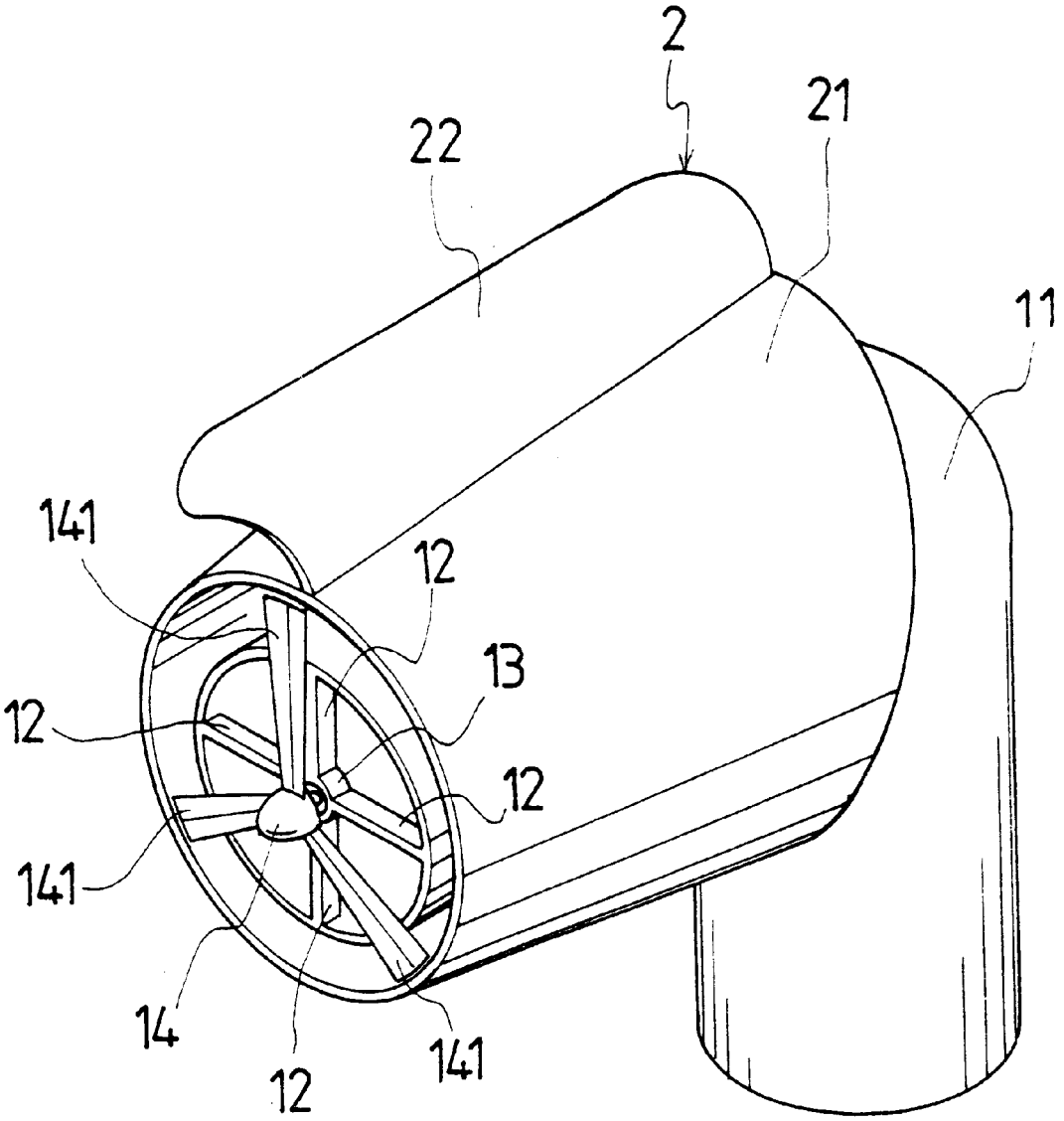
FIG. 5 is a three-dimensional perspective of the invention in the embodiment of an Automatic Directional Ventilator.
Figure 6:
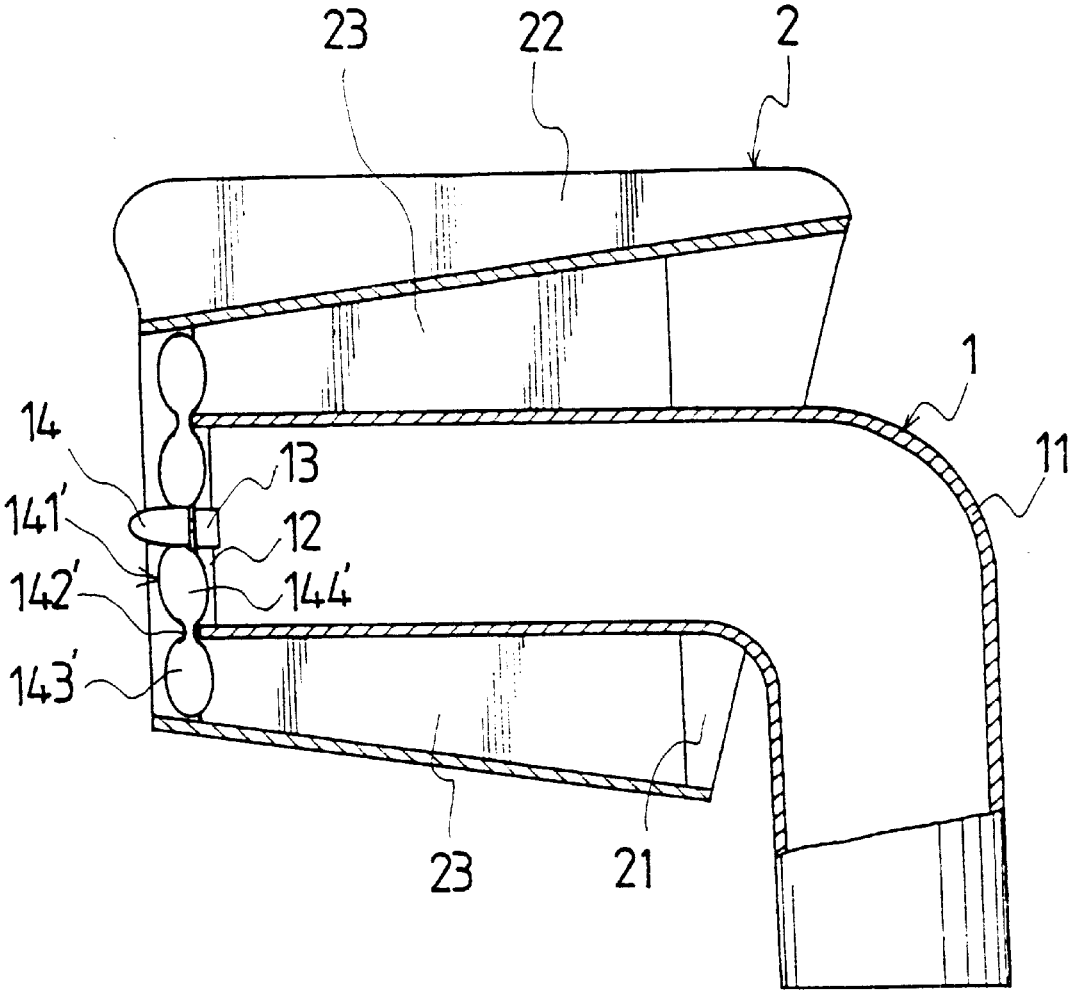
FIG. 6 is a cross-section view of another embodiment of the invention, realized in a Fan Structure.
Figure 7:
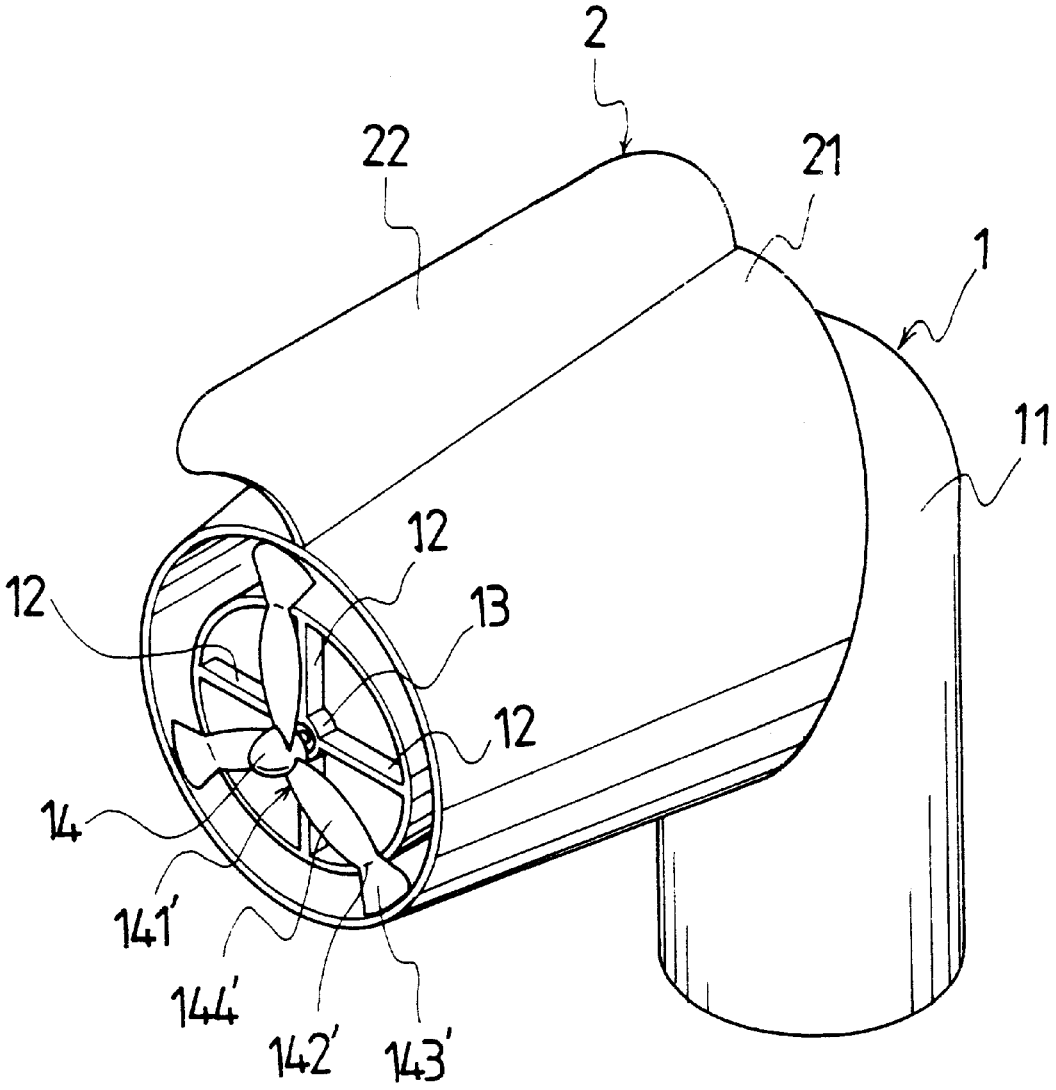
FIG. 7 is a three-dimensional view of another embodiment of the invention, realized in a Fan Structure.

By referring to FIG. 4, FIG. 5 it will be appreciated that with the invention, several irradiant ribs 12 at the outlet of the drafting pipe 11 may be secured to the midpoint of a hinge 13 at the forward section of the hinge 13 is installed articulatorily an axial fan 14 which is surrounded by a number of irradiating, plate-form vane 141 with legs declined in a common direction, and extending to the outlet of the Current Conduit Hood 2, such as is shown in FIG. 6, FIG. 7, said plate-form vane 141' may also incorporated a retraction 142' at the mid-section in common with the edge of the drafting pipe 11, to account for a two-section structure of the vane 141', the vane in this instance still declined in a common direction, so that the section 143' facing the wind on the terminal end of the vane 141' just extends to the outlet of the Conduit Hood 2, while the section 144' to pull the wind sets inside the outlet of the drafting pipe 11, to account for the drafting structure of a fan. When natural wind gets an increase in pressure to blow out of the Conduit Hood 2, the terminal tip of vane 141, 141' will get a push, or instead the wind facing section 143' will get a push to set the axial fan 14 to rotation, meanwhile the air in the draft pipe 11, by way of the interior section of vane 141, 141', or by way of the wind pull section 144', will be drafted out synchronously, since that the axial fan 14 is driven by the blowing of wind power pressurized at the Conduit Hood 2, the corresponding rotation speed will increase in like measure, interpreted in excellent drafting efficiency.

Figure 8:
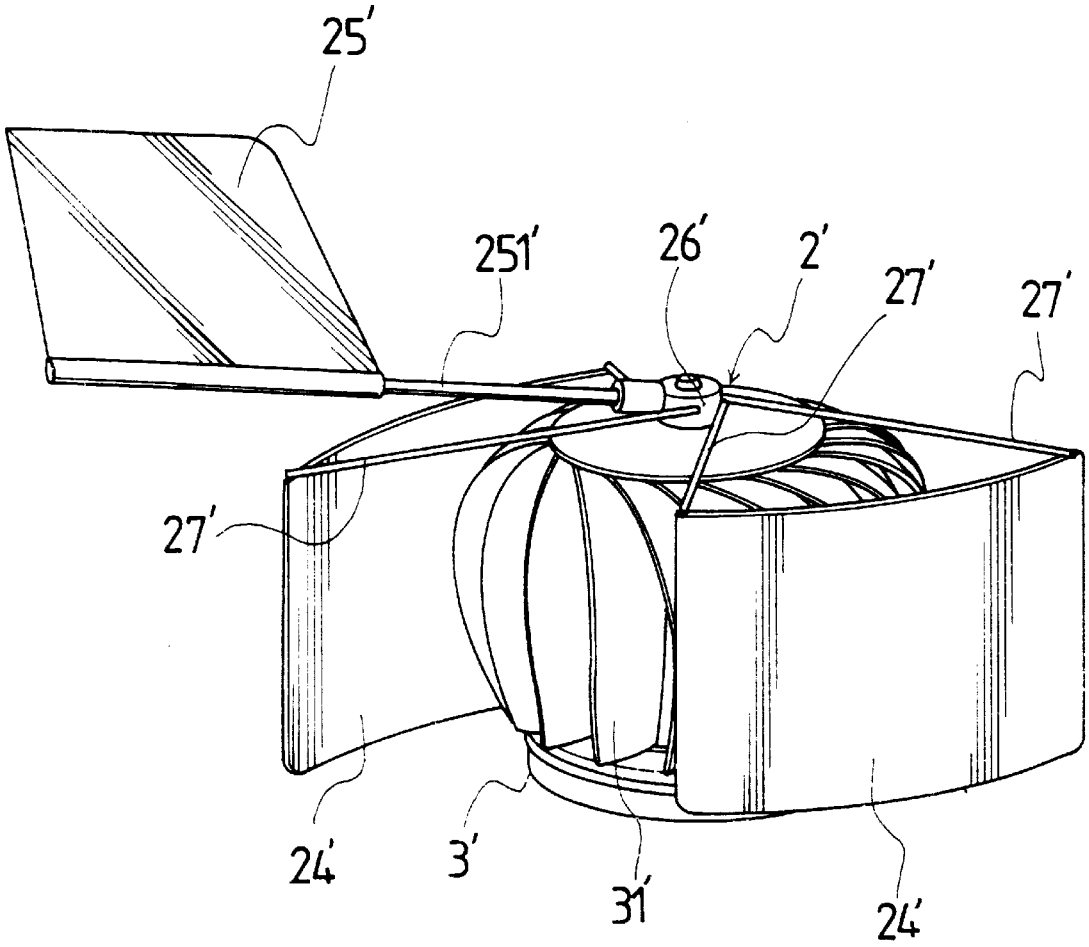
FIG. 8 is a three-dimensional view of the invention in the embodiment of a Worm Gear Type Ventilator.
Figure 9:
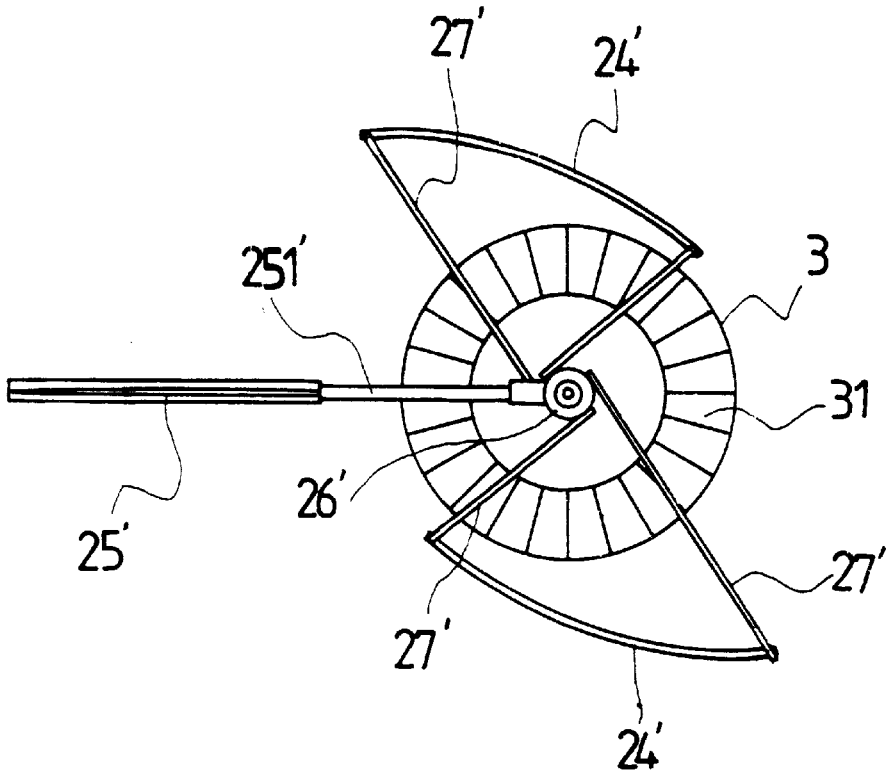
FIG. 9 is a top view of the invention in the embodiment of a Worm Gear Type Ventilator.
Figure 10:
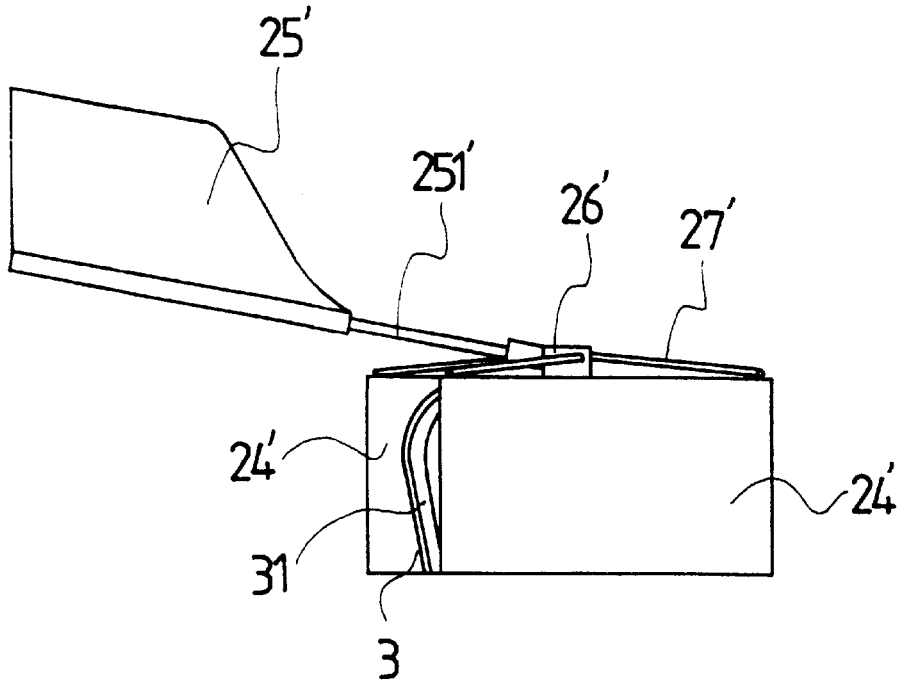
FIG. 10 is a side view of the invention in the embodiment of a Worm Gear Type Ventilator.
Figure 11:
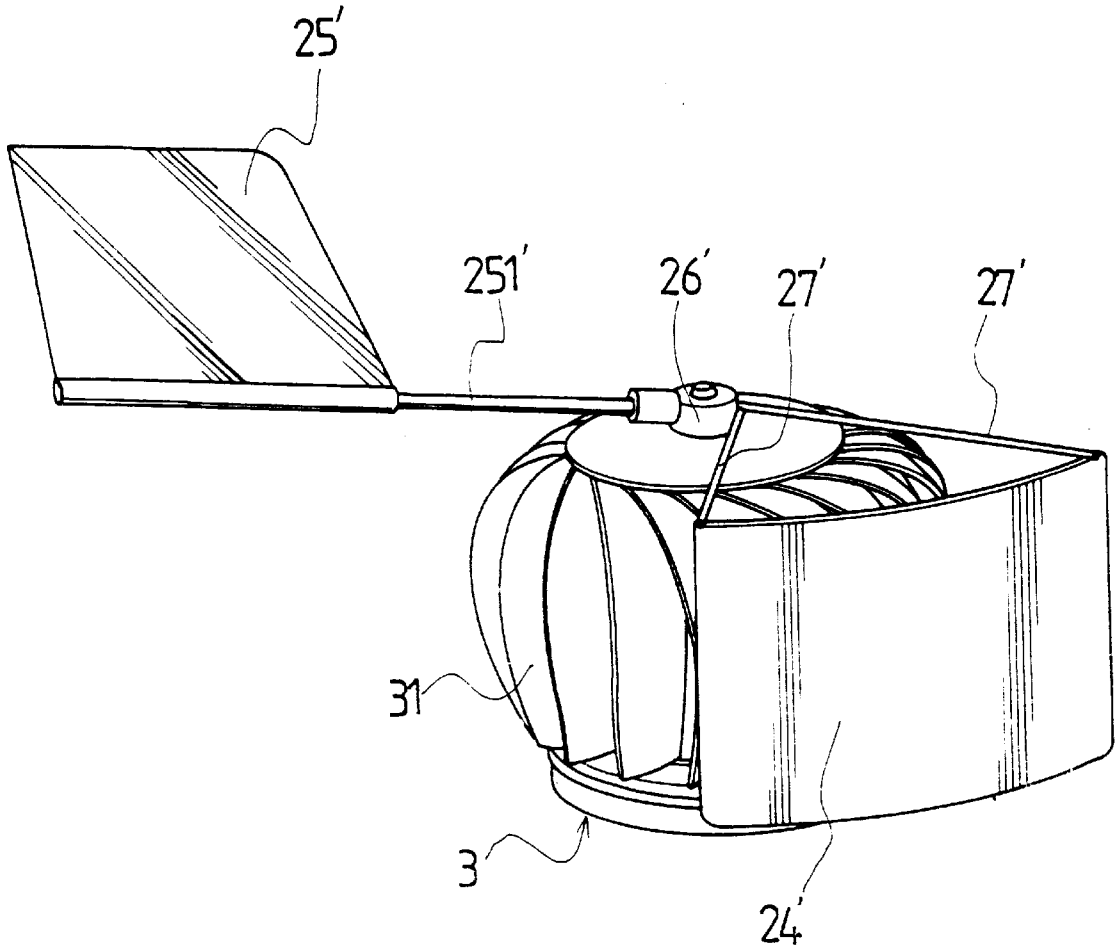
FIG. 11 is a three-dimensional perspective of a further example of the invention embodied in a Worm Gear Type Ventilator.
Figure 12:
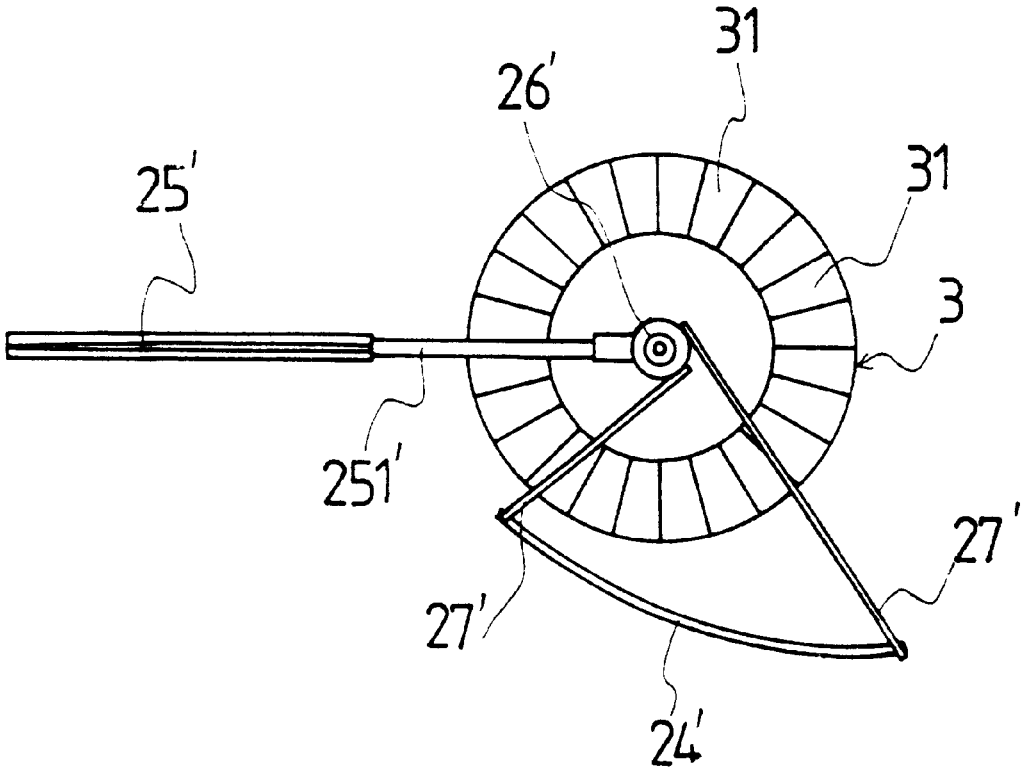
FIG. 12 is a top view of a further example of the invention embodied in a Worm Gear Type Ventilator; and, FIG. 13 is an illustration of an embodiment of the invention in a Worm Gear Type Ventilator in operation.

Executed in another embodiment, the invention consists of a worm Gear Draft 3 and a Current Conduit Hood 2', such as is shown in FIG. 8, whereof:

The Worm Gear Draft 3, such as is shown in FIG. 8, FIG. 9, is executed in a roughly spheroidal profile, comprising peripherally a number of arched vane 31, by its side facing the wind the vane 31 may be driven by natural wind to rotation;

The Conduit Hood 2', such as is shown in FIG. 8 and FIG. 11, consists essentially of one or two arched plate 24', a directional vane 25', a hinge 26' and fixing rod 27', the Directional Vane 25' is vertically set, having a strut 251' protruded from the frontal tip on its bottom secured to the hinge 26' which is configured essentially like a round plunger attached on one side or both sides with two fixing rods 27', which in turn are each secured to the frontal, rear sides of the upper side of an arched plate 24' so that the arched plate 24' sets in a downgoing setting, constituting one or two arched plates 24' abutting one side of the hinge 26', with the arched plate 24' on one side exposed in the forward direction, where two such arched plates 24' are provided, the other plate 24' on the other side sets exposed rearwards;

In this manner the hinge 26' is articulatorily mounted in the center on top of the Worm Gear Ventilator 3, by having one or two arched plates 24' mounted respectively on lateral sides of the Worm Gear Ventilator 3, with arched plate 24' on one side exposed forwardly, but where two arched plates are provided 24' then the arched plate 24' on the other side will be exposed posteriorly, such as is shown in FIG. 9 and FIG. 12, that is, both arched plates 24' being slightly exposed, splayed in the direction into which the Worm Gear ventilator 3 rotates, while the directional vane 25' is positioned behind the Worm Gear Ventilator 3, way between both arched plates, slightly above, seen axially, and that by and large constitutes the invention Ventilator by Force of Nature with Pressurization Conduit Hood, as is shown in FIG. 8 and FIG. 11.

Figure 13:
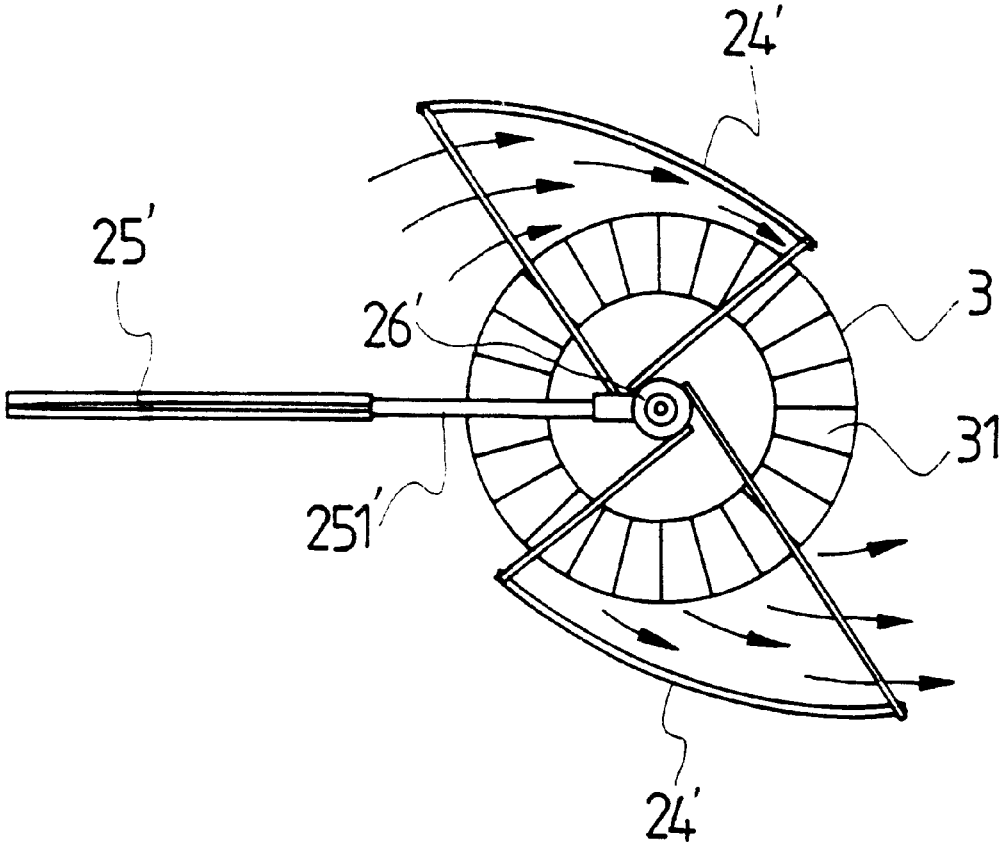

In that arrangement, the vertical going Directional Vane 25' controls the arched plate 24' on one side of the Conduit Hood 2' to face the side where wind comes from, once natural wind blows inside the arched plate 24', the incoming wind gets guided by the reducing configuration of an arched profile, meantime a pressurizing effect is brought upon the wind which is further led into vane 31 on one side of the Worm Gear Ventilator 3 whereby the Worm Gear Ventilator 3 is driven into rotation, when this happens hot gases indoors is being pumped out at the same time by vane 31 on the other side, such as is shown in FIG. 13; the purpose of the invention lies essentially in boosting effects of a Worm Gear Ventilator 3 in operation, that is, active in rotation, the rotative structure of the Worm Gear Ventilator 3 being conventional the detail of which is saved from further description herein; with the invention, pressurization is induced to incoming natural wind by the action of an arched plate 24' incorporated as a part of the Conduit Hood 2', as a result, when the Worm Gear Ventilator is being driven by pressurized natural wind, the rate of rotation will increase somewhat accompanied by an enhanced drafting performance, this advantage over conventional type Worm Gear Ventilators is more evident in summer when the natural wind is generally the weakest throughout an year.

What is claimed is:

1. A wind-powered ventilator assembly, comprising:

a ventilator arranged to exhaust air through an exhaust opening by force of natural wind; and a pressurization hood mounted on a periphery of the ventilator, said pressurization hood having an outlet aligned with said exhaust opening such that wind passing through said pressurization hood exits through said outlet and passes said exhaust opening to draw said exhaust air out of said ventilator, wherein said pressurization hood is tapered to continually increase a wind force passing completely through the pressurization hood, such that said continually increasing wind force exiting through the outlet aligned with said exhaust opening increases an amount of air drawn from said exhaust opening by said wind, wherein said ventilator comprises:

an elbow draft pipe having first and second ends, the elbow draft pipe including a vertical first leg having an opening at the first end of the elbow draft pipe and a horizontal second leg having said exhaust opening at the second end of the elbow draft pipe, said first end being rotatably fitted in an opening in a chassis and said elbow draft pipe being arranged to rotate relative to said chassis within said chassis opening, a generally cylindrical conduit hood installed on a perimeter of said elbow draft pipe, said conduit hood being attached to the ventilator by at least one axially extending rib, wherein a diameter of said generally cylindrical conduit hood at said outlet aligned with said exhaust opening at the second end of the elbow draft pipe is smaller than a diameter of said generally cylindrical conduit hood at an inlet end to thereby provide said pressurization effect, and further comprising at least one radially extending rib attached to a hub at the second end of the elbow draft pipe, and a fan articulated to a front side of said hub, said fan including a plurality of vanes whose distal ends extend close to said conduit hood, said fan being driven by pressurized air exiting from said conduit hood to pump air from said exhaust opening, said vanes each including a neck located at a side of said ventilator exhaust opening, and said vanes being declined in a common direction.

2. A wind-powered ventilator assembly, comprising:

a ventilator arranged to exhaust air through an exhaust opening by force of natural wind; and a pressurization hood mounted on a periphery of the ventilator, said pressurization hood having an outlet aligned with said exhaust opening such that wind passing through said pressurization hood exits through said outlet and passes said exhaust opening to draw said exhaust air out of said ventilator, wherein said pressurization hood is tapered to continually increase a wind force passing completely through the pressurization hood, such that said continually increasing wind force exiting through the outlet aligned with said exhaust opening increases an amount of air drawn from said exhaust opening by said wind, and wherein said ventilator comprises a worm gear including a plurality of arched vanes on a perimeter of the worm gear, and wherein said conduit hood comprises at least one arched plate, a directional vane, and a hub, said hub being connected to one end of the worm gear, said directional vane extending upwardly from said hub and said at least one arched plate extending downwardly past said worm gear, said hub being rotatable relative to said worm gear to permit said at least one arched plate to rotate relative to the worm gear in response to a force of wind against said directional vane, and said arched plate having first and second ends, the first end of said arched plate being further from said worm gear than the second end of said arched plate to thereby pressurize wind passing between said arched plate and said worm gear.

3. A wind-powered ventilator assembly as claimed in claim 2, wherein said ventilator comprises:

an elbow draft pipe having first and second ends, the elbow draft pipe including a vertical first leg having an opening at the first end of the elbow draft pipe and a horizontal second leg having said exhaust opening at the second end of the elbow draft pipe, said first end being rotatably fitted in an opening in a chassis and said elbow draft pipe being arranged to rotate relative to said chassis within said chassis opening, a generally cylindrical conduit hood installed on a perimeter of said elbow draft pipe, said conduit hood being attached to the ventilator by at least one axially extending rib, and wherein a diameter of said generally cylindrical conduit hood at said outlet aligned with said exhaust opening at the second end of the elbow draft pipe is smaller than a diameter of said generally cylindrical conduit hood at an inlet end to thereby provide said pressurization effect.

4. A wind-powered ventilator assembly as claimed in claim 1, wherein an axially extending, plate-shaped directional vane extends from a top of an outer wall of said conduit hood, said vane being arranged to cause said ventilator to automatically rotate to a predetermined position relative to a direction of said wind.

5. A wind-powered ventilator assembly as claimed in claim 2, wherein said ventilator comprises:

an elbow draft pipe having first and second ends, the elbow draft pipe including a vertical first leg having an opening at the first end of the elbow draft pipe and a horizontal second leg having said exhaust opening at the second end of the elbow draft pipe, said first end being rotatably fitted in an opening in a chassis and said elbow draft pipe being arranged to rotate relative to said chassis within said chassis opening, a generally cylindrical conduit hood installed on a perimeter of said elbow draft pipe, said conduit hood being attached to the ventilator by at least one axially extending rib, and wherein a diameter of said generally cylindrical conduit hood at said outlet aligned with said exhaust opening at the second end of the elbow draft pipe is smaller than a diameter of said generally cylindrical conduit hood at an inlet end to thereby provide said pressurization effect, and wherein an axially extending, plate-shaped directional vane extends from a top of an outer wall of said conduit hood, said vane being arranged to cause said ventilator to automatically rotate to a position wherein said inlet of said pressurization hood faces said wind.

6. A wind-powered ventilator assembly as claimed in claim 1, further comprising at least one radially extending rib attached to a hub at the second end of the elbow draft pipe, and a fan articulated to a front side of said hub, said fan including a plurality of vanes whose distal ends extend close to said conduit hood, said fan being driven by pressurized air exiting from said conduit hood to pump air from said exhaust opening.

7. A wind-powered ventilator assembly as claimed in claim 6, wherein said vanes each includes a neck located at a side of said ventilator exhaust opening.

8. A wind-powered ventilator assembly as claimed in claim 2, wherein a number of said arched plates is two.

* * * * *